US007573696B2

(12) United States Patent
Thulin

(10) Patent No.: US 7,573,696 B2
(45) Date of Patent: Aug. 11, 2009

(54) DEVICE FOR DISSIPATING STATIC ELECTRICITY

(75) Inventor: Anders Thulin, Saltsjöbaden (SE)

(73) Assignee: Anders Thulin Consulting AB, Saltsjöbaden (SE)

( * ) Notice: Subject to any disclaimer, the term of this patent is extended or adjusted under 35 U.S.C. 154(b) by 283 days.

(21) Appl. No.: 10/584,659

(22) PCT Filed: Jan. 28, 2005

(86) PCT No.: PCT/SE2005/000099

§ 371 (c)(1),
(2), (4) Date: Jun. 26, 2006

(87) PCT Pub. No.: WO2005/074075

PCT Pub. Date: Aug. 8, 2005

(65) Prior Publication Data

US 2008/0055812 A1 Mar. 6, 2008

(30) Foreign Application Priority Data

Jan. 29, 2004 (SE) ..... 0400166

(51) Int. Cl.
*H05F 3/00* (2006.01)
*H05F 3/02* (2006.01)

(52) U.S. Cl. ..... 361/220; 361/112; 361/222

(58) Field of Classification Search ..... 361/220, 361/212, 222
See application file for complete search history.

(56) References Cited

U.S. PATENT DOCUMENTS 3,705,324 A * 12/1972 Masuda ..... 313/517
4,166,729 A 9/1979 Thompson et al.
4,749,362 A * 6/1988 Hoffman et al. ..... 439/269.1
4,977,386 A * 12/1990 Lodini ..... 338/114
5,246,157 A * 9/1993 Siegel ..... 228/55
5,280,979 A * 1/1994 Poli et al. ..... 294/64.1
5,708,552 A * 1/1998 Han et al. ..... 361/799

(Continued)

FOREIGN PATENT DOCUMENTS

GB 2090547 A 7/1982

(Continued)

OTHER PUBLICATIONS

International Search Report for PCT/SE/2005/000099 dated May 10, 2005.

*Primary Examiner*—Stephen W Jackson
*Assistant Examiner*—Zeev Kitov
(74) *Attorney, Agent, or Firm*—Potomac Patent Group PLLC

(57) ABSTRACT

A device for safe dissipation of static electricity or charge from an object, comprising at least one conductive contacting means intended to be applied in contact with the object and to be connected to a point capable of dissipating electric current. The contacting means is connected to the dissipation point via a low conductive material for slow dissipation of current from the object, such that the formation of sparks is avoided. Preferably, the low conductive material comprises an insulating matrix, such as plastics, and a conductive additive mixed therein, such as metallic powder or soot. A potential recharging of the object will then be dissipated relatively slowly during initial contact with the device such that no spark can be released. Thereby, an explosion or fire can be avoided in hazardous environments, particularly in the field of chemical industry.

8 Claims, 1 Drawing Sheet

U.S. PATENT DOCUMENTS 5,812,357 A * 9/1998 Johansen et al. ..... 361/212
2001/0050270 A1 * 12/2001 Sato et al. ..... 219/69.15

FOREIGN PATENT DOCUMENTS

JP 410273639 * 10/1998
SU 0856048 A1 8/1981
SU 1309335 A1 5/1987

* cited by examiner

DEVICE FOR DISSIPATING STATIC ELECTRICITY

This application claims priority and benefit from International Application No. PCT/SE2005/000099. filed Jan. 28, 2005, which claims priority to Swedish patent application No. 0400166-5, filed Jan. 29, 2004, the entire teachings of which are incorporated herein by reference.

TECHNICAL FIELD

The present invention relates to a device for safe dissipation of static electricity or charge, where spark formation is avoided.

BACKGROUND OF THE INVENTION

When handling explosive materials and products, and in environments where highly inflammable gases or materials are present, the formation of sparks poses a potential risk for explosion and/or fire. For example, the air in certain industrial environments, particularly in the field of chemical industry, may comprise gasses generated by volatile substances in dyers baths, solvents, cleaning compounds, adhesive substances, etc., which can easily be ignited by the slightest spark, which of course may result in disastrous consequences. Dust stuff that can easily catch fire may also occur. In such environments, it is therefore important to take measures in order to eliminate such risks.

A spark can easily appear by the discharge of static electricity or when hard objects hit each other, e.g. metallic tools, instruments or machines hitting something or being dropped to the floor. The formation of sparks during shocks can be avoided by covering the objects with a softer material, such as plastics or rubber, which is not always a good solution in practice, however. In the case of static electricity, it is a problem that more or less electrically conductive objects are electrostatically charged during handling, in order to finally be discharged at the formation of a spark against another object, or a person, e.g. being in contact with earth.

Such charging of objects can be prevented by having the present object in constant connection with earth for continuous drainage of generated static electricity. For example, a metallic object such as a tool, a sheet-metal bench or a machine casing, may be connected to earth by applying a conductive clamp or the like to the object, wherein the clamp is connected to earth by means of a cable or the like.

In FIG. 1, a commonly occurring grounding clamp 100 made in a conductive metal is shown, comprising two pointed opposite contacting means 102*a* and 102*b*, which are held pressed against each other by means of a spring 104, for contacting the object. The contacting means can be opened by hand by means of two hingedly connected arms 106*a* and 106*b*, each being connected to a contacting means 102*a, b*, respectively. At least one of the arms 106*a* is by means of a cable 108 further connected to a point of dissipation P, such as earth. Once the metal clamp 100 is applied to an object, the contacting means 102*a, b* will dissipate current from the object through the cable to earth, such that it cannot be recharged electrostatically.

Other types of grounding clamps are also occurring, e.g., C-shaped clamps with screwed contacting means, and pipe clamps with two semi-circular contacting means which are screwed together towards each other around a pipe or a rod to be drained. The contacting means occurring in these grounding clamps are typically provided with at least one metal point or spike, in order to provide a safe electric contact to the object to be drained, such that it can penetrate dirt, layers of oxide, paint coats or the like that may often occur.

However, a problem with such previously known clamps is that an object has already been charged to some extent when the clamp is to be connected thereto. A spark may thereby be released unintentionally as the clamp instantaneously discharges the object when initially contacting it, or possibly when the cable 108 is connected to earth after the clamp has been applied at the object, possibly resulting in an explosion or fire. Such a discharge may also be caused by a capacitance being built up in the clamp itself, especially if its metallic mass is relatively great. Furthermore, there is a certain risk that the clamp is dropped to the floor or bumps into some object during handling thereof, such that a spark may even then be released, a so-called slag spark.

SU 856048 A discloses a discharging device for high voltage applications, which is used to remove a charge from a conductor where electrical energy has been accumulated. When applying the device to the conductor, a spark appears with a current limited by a semi-conductor rod in the device.

SUMMARY OF THE INVENTION

It is an object of the present invention to obtain a simple yet effective solution to obtain safe dissipation of static electricity in objects such that spark formation is avoided, particularly when initially connecting the object to earth.

Another object of the invention is to avoid the formation of sparks if this device should unintentionally hit some other hard object or material, such as a stone floor or a sheet-metal bench.

These objects and others are obtained by means of an electrically dissipating device comprising at least one conductive means intended to be applied in contact with the object and to be connected to a point capable of dissipating electric current. The contacting means is connected to the dissipation point via a low conductive material for slow dissipation of current from the object, such that the formation of sparks is avoided, primarily when applying the dissipating device on the object.

The low conductive material preferably comprises an insulating matrix and a conductive additive mixed therein, in order to obtain the desired conductivity. The matrix may be composed of a plastic, e.g. polyamide, and the conductive additive may be composed of a metallic powder or soot or fibres.

The dissipating device is preferably formed as a clamp having two opposite conductive contacting means which are biased against each other by means of a spring, two mutually hinged arms connected to respective contacting means, and a dissipation cable intended to be connected to said dissipation point. The low conductive material may then be included in at least one of the arms, such that at least one of the contacting means is connected to the dissipation cable via the low conductive material. However, the invention is not limited to any particular shape of the device and/or placement/arrangement of the low conducting material.

BRIEF DESCRIPTION OF THE DRAWINGS

The present invention is described in more detail below with reference to the attached drawings.

DETAILED DESCRIPTION OF PREFERRED EMBODIMENTS

Figure 1:
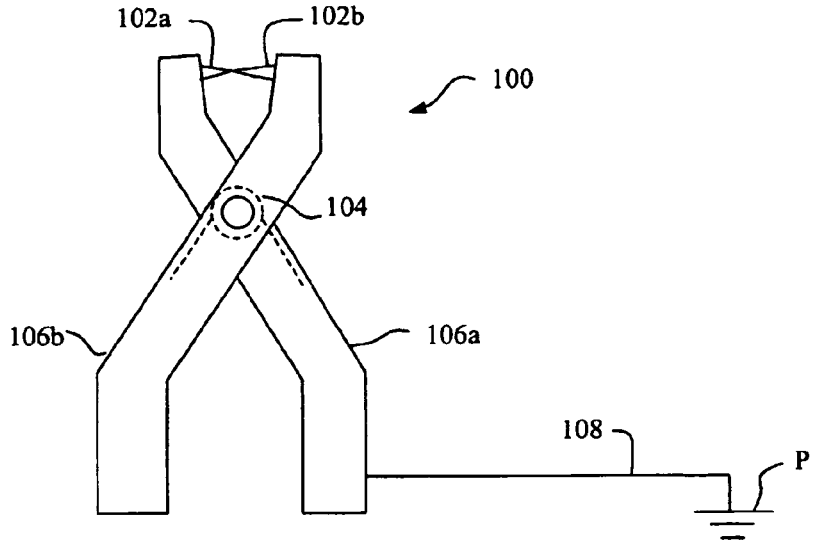
FIG. 1 is a schematic view of a known grounding clamp.
Figure 2:
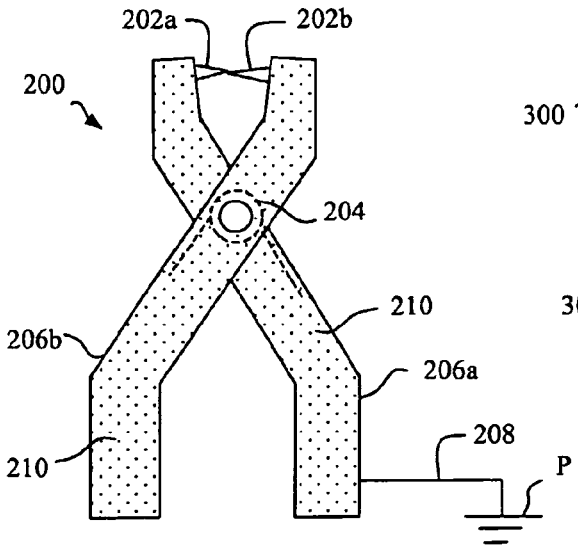
FIG. 2 is a schematic view of a first embodiment of a device for the dissipation of static electricity, in accordance with the present invention.

FIG. 2 illustrates a first embodiment of an electrically dissipating device, in accordance with the present invention. In this example, the dissipating device is formed as a clamp 200 having the same exterior shape as the known clamp shown in FIG. 1, i.e. with two conductive contacting means 202*a* and 202*b* which are biased against each other by means of a spring 204, and two arms 206*a* and 206*b* connected to respective contacting means. However, other embodiments of the shape of the dissipating device are also possible within the scope of the present invention, which is thus not limited by the shown examples.

In order to primarily avoid the formation of sparks when the clamp is applied on an object to be drained/grounded, the contacting means 202*a, b* of the dissipating device are connected to a dissipation cable 208 via a material in the clamp having a substantially restricted capability of conducting electricity, hereafter called "low conductive material", in contrast to highly conductive metallic materials. In the example shown in FIG. 1, the arms 206*a, b* are made in such a low conductive material 210, while the contacting means 202*a, b* are made in some suitable highly conductive metal for favourable contact with the object. At least one of the arms is coupled to the cable 208 which in turn can be connected to a point P capable of dissipating current, e.g. earth.

Thus, the low conductive material in the arms 206*a, b* has significantly poorer electric conductivity than metals, but is still not completely insulating. Thereby, the advantageous effect in this situation arises that current will be dissipated relatively slowly away from the object by means of the low conductive material, once the clamp is connected to the object. Hence, the object cannot be discharged instantaneously at initial contact with the clamp 200, but the discharging will occur relatively slowly so that a spark will not be released. Thereafter, the low conductive material in the arms 206*a, b* will still ensure continuous draining of static electricity from the object so that it cannot be recharged. In order to further increase security, the contacting means 202*a, b* should be made with a relatively low mass, in order to avoid that a capacitance is built up in the associated points and that themselves thereby cause the formation of sparks.

Preferably, the low conductive material is composed of an insulating matrix, e.g. reinforced plastics, which includes a conductive component mixed in the matrix, e.g. a metallic powder or carbon powder (say, in the form of soot) or conductive fibres. During manufacture of the electrically dissipating device, the conductive component can easily be mixed into the matrix at a fraction to obtain a desirable conductivity in the low conductive material. As a feasible example in practice of a low conductive material, a matrix of polyamide having roughly 10-20% soot as a conductive component may be given. However, the low conductive material may optionally be any material having such conductive characteristics, such as any suitable ceramic material or ebonite. In addition to the desired low conductive characteristics, the selection of materials is in practice of course further dependent on other factors, such as mechanical properties, workability, price, etc., which are not considered in this description, however.

Figure 3:
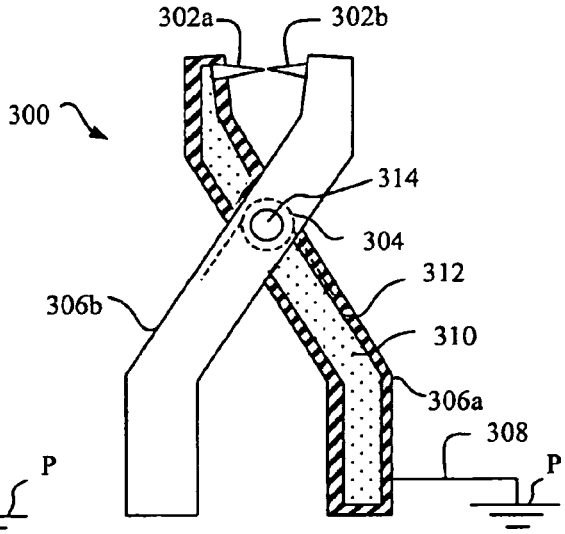
FIG. 3 is a schematic view, partly in cross section, of a second embodiment of a device for the dissipation of static electricity, in accordance with the present invention.

FIG. 3 illustrates a second possible embodiment of an electrically dissipating device, in accordance with the present invention. In this example, the dissipating device is likewise formed as a clamp 300 having two conductive contacting means 302*a* and 302*b* which are biased against each other by means of a spring 304, and two mutually hinged arms 306*a* and 306*b* connected to respective contacting means. Here, however, at least one of the arms 306*a*, shown in cross section, is formed with an interior part 310 of a low conductive material which is surrounded by an exterior part 312 of an insulating material, e.g. plastics. Thus, the interior part 310 provides electric connection between the contacting means 302*a* and the dissipation cable 308, to ensure slow and safe draining of current from the object without the risk of spark formation, as described above.

The embodiment illustrated in FIG. 3 may be varied in different ways. Although it is normally sufficient that only one of the arms comprises the low conductive material such that the associated contacting means 302*a* is connected to the dissipation cable 308, both arms 306*a, b* may of course be formed in this way, each having connection with the cable 308, in order to further increase security. Alternatively, the interior part 310 may instead be made of an insulating material, while the exterior part 312 is a cover of low conductive material connecting the associated contacting means with the cable.

The second arm 306*b* in FIG. 3 may also be provided with an interior part of a low conductive material, not shown, that merely extends from the contacting means 302*b* up to the joint 314 connecting the two arms, such that current can be conducted from the contacting means 302*b* via the joint 314 over to the interior part 310 of a low conductive material in the first arm 302*a*. In the case where only one of the arms is formed with a low conductive material, it is sufficient to provide one associated contacting means on that arm, wherein a suitable counter surface may be arranged on the opposite arm.

By means of the above-described invented device, a potential recharging of the object will thus be dissipated relatively slowly during initial contact with the device, whereby no spark can be released. In this context, a "slow" discharge means up to one second, whereas discharging through a highly conductive material, such as a metal, occur within a few nano seconds, resulting in the formation of a spark. Furthermore, the desirable characteristic is provided of continuously dissipating the charging incurred to the object in course of time as a faint current through the low conductive material. Further, this result is achieved even if the object should unintentionally come into contact with other charged objects during handling thereof.

If the device is formed with a low conductive or insulating material on its outer surfaces and/or points, the formation of sparks will further be avoided at unintentional shocks against hard surfaces, e.g. if the device is dropped to the floor during handling of the device. In order to completely eliminate this shock hazard, the metallic parts, i.e. the contacting means and possibly also the joint, can be placed in the device in shielded recessed positions relative the low conductive and/or insulating parts.

Of course, further modifications and combinations of the above-described embodiments are conceivable within the scope of the invention. Thus, the invention is not exclusively limited to the described embodiments, but is generally defined by the following claims.

The invention claimed is:

1. A device for the dissipation of electricity from an object, the device comprising at least one highly conductive contacting means intended to be applied in contact with the object and to be connected to a dissipation point capable of dissipating electric current, and a low conductive material for slow dissipation of current from the object, wherein during use, for safe dissipation of static electricity from the object, the contacting means is connected to the dissipation point via the low conductive material, such that when said contacting means is applied into contact with the object the current is first dissipated from the object over to the highly conductive contacting means, then through the low conductive material, and finally to the dissipation point, wherein the formation of sparks is avoided, wherein the device is formed as a clamp having two opposite conductive contacting means which are biased against each other by means of a spring, two mutually hinged arms connected to respective contacting means, and a dissipation cable intended to be connected to said dissipation point, wherein the low conductive material is included in at least one of the arms, such that at least one of the contacting means is connected to the dissipation cable via the low conductive material;

wherein at least one of the arms is provided with an interior part of an insulating material and an exterior cover of the low conductive material.

2. A device according to claim 1, wherein at least one of the arms is made of the low conductive material.

3. A device according to claim 1, wherein at least one of the arms is provided with an interior part of the low conductive material and an exterior part of an insulating material surrounding the interior part.

4. A device according to claim 1, wherein at least one of the contacting means comprises at least one metal part of a low mass.

5. A device according to claim 1, wherein the low conductive material comprises an insulating matrix and a conductive additive mixed therein.

6. A device according to claim 5, wherein the matrix is composed of a plastic and the conductive additive is composed of a metallic powder or soot or fibers.

7. A device according to claim 6, wherein the matrix is composed of polyamide.

8. A device according to claim 1, wherein the low conductive material comprises a ceramic material or ebonite.

* * * * *